US006102454A

United States Patent [19]

Weyerstall

[11] Patent Number: 6,102,454

[45] **Date of Patent: *Aug. 15, 2000**

[54] MOTOR VEHICLE DOOR LOCK ARRANGEMENT

[75] Inventor: Bernd Weyerstall, Wuppertal, Germany

[73] Assignee: Robert Bosch GmbH, Stuttgart, Germany

[ * ] Notice: This patent is subject to a terminal disclaimer.

[21] Appl. No.: 09/153,454

[22] Filed: Sep. 15, 1998

[30] Foreign Application Priority Data

Sep. 15, 1997 [DE] Germany ..... 197 41 142
Dec. 6, 1997 [DE] Germany ..... 197 54 216

[51] Int. Cl.[7] ..... E05C 3/06

[52] U.S. Cl. ..... 292/201; 292/216

[58] Field of Search ..... 292/201, 216, 292/DIG. 23

[56] References Cited

U.S. PATENT DOCUMENTS

| | | | |
|---|---|---|---|
| 4,843,849 | 7/1989 | Kamke et al. | 292/201 X |
| 5,007,261 | 4/1991 | Quantz | 70/240 |
| 5,537,848 | 7/1996 | Grzanka et al. | 70/279.1 |
| 5,567,003 | 10/1996 | Ursel et al. | 70/472 |
| 5,603,537 | 2/1997 | Amano et al. | 292/201 |
| 5,615,564 | 4/1997 | Inoue | 292/201 X |
| 5,715,713 | 2/1998 | Aubry et al. | 70/277 |
| 5,855,130 | 1/1999 | Rorabacher et al. | 70/277 |
| 5,901,991 | 5/1999 | Hugel et al. | 292/201 |
| 5,938,253 | 8/1999 | Szablewski et al. | 292/216 |

FOREIGN PATENT DOCUMENTS

| | | |
|---|---|---|
| 0 153 231 | 8/1985 | European Pat. Off. . |
| 0 584 499 | 3/1994 | European Pat. Off. . |
| 0 589 158 | 3/1994 | European Pat. Off. . |
| 39 24 231 | 2/1990 | Germany . |
| 195 01 493 | 7/1996 | Germany . |
| 195 45 722 | 4/1997 | Germany . |
| 195 47 724 | 6/1997 | Germany . |
| 196 31 869 | 2/1998 | Germany . |

*Primary Examiner*—B. Dayoan
*Assistant Examiner*—Gary Estremsky
*Attorney, Agent, or Firm*—Nixon Peabody LLP; David S. Safran

[57] ABSTRACT

A motor vehicle door lock arrangement with a lock latch, a detent pawl and an electrical detent pawl drive with control switches for a triggering detent pawl drive, a power supply connection and a lock mechanism with at least one mechanical opening lever which acts on the detent pawl. In the normal case, the detent pawl can be actuated only by the electrical detent pawl drive (1), and in an emergency, by the mechanical opening lever (2). The motor vehicle door lock arrangement provides the electrical detent pawl drive (1) with a mechanical energy storage device (15) which is tensioned in the rest position of the detent pawl drive (1) and which keeps the opening lever (2) prepared for mechanical activation should the power supply fail or some other malfunction of electrical detent pawl drive occur.

13 Claims, 6 Drawing Sheets

MOTOR VEHICLE DOOR LOCK ARRANGEMENT

BACKGROUND OF THE INVENTION

1. Field of the Invention

The invention relates to a motor vehicle door lock arrangement having a lock latch, a detent pawl and an electrical detent pawl drive, with control switches for triggering the electric detent pawl drive, with a power supply connection and with a lock mechanism with at least one mechanical opening lever which acts on the detent pawl, and in the normal case, the detent pawl can be activated only by the electrical detent pawl drive, and in the emergency case, by the mechanical opening lever.

2. Description of Related Art

Motor vehicle door lock arrangements of the above described type have been known for some time and are generally referred to as so-called "electric locks" (see, for example, published European Patent Application EP-A-0 589 158, and published German Patent Application DE-A-195 45 722). In an electric lock, there is always the problem that provisions must be made for a power failure or other malfunction of the electrical detent pawl drive. It must be ensured that, even in this emergency, the motor vehicle door can be opened.

There are different approaches to taking into account the aforementioned emergency. There is, for example, the equipment of the respective individual motor vehicle door lock arrangement can be provided with its own emergency power supply which is independent of the motor vehicle electrical system. Then, in the case of an emergency, switching from the motor vehicle electrical system to the emergency power supply takes place (see EP-A-0 584 499). This requires a switching process, and in addition, backing-up the emergency power supply on each door lock means with the necessity of always ensuring its serviceability. Another approach is a type of dynamo function for an emergency by which by repeated actuation of the mechanical opening lever, for example, from the outside handle, charges a storage device for electrical energy (e.g., a battery, capacitor, etc.) to such a level that the emergency function occurs. Another approach is a permanently serviceable mechanical redundancy, with which a mechanical opening actuation can be produced from a lock cylinder or other location (see, published German Patent Applications DE-A-195 45 722 and DE-A-195 01 493.).

Another approach is to provide the electrical detent pawl drive with a mechanical energy storage device which, when the power supply fails or upon some other malfunction of the electrical detent pawl drive, automatically actuates the mechanical opening lever (see, European Patent Application EP-A-0 589 158). A solenoid is provided with an armature which, in the normal case, is continuously spring pretensioned by the mechanical energy storage device, and when the current fails, is shifted into the emergency position by the spring pretension (DE-A-196 31 869)

SUMMARY OF THE INVENTION

A primary object of the present invention is to devise a motor vehicle door lock arrangement which does not require an emergency power supply, a switching relay and/or a dynamo function, and which can be actuated, however, only in an emergency by a mechanical opening lever.

The aforementioned object is achieved by the electrical detent pawl drive being provided with a mechanical energy storage device which in the rest position of the detent pawl drive is tensioned and keeps the opening lever prepared for mechanical activation when the power supply fails or for some other malfunction of the electrical detent pawl drive.

These and further objects, features and advantages of the present invention will become apparent from the following description when taken in connection with the accompanying drawings which, for purposes of illustration only, shows a single embodiment in accordance with the present invention.

BRIEF DESCRIPTION OF THE DRAWINGS

FIG. 4 is a view of the motor vehicle door lock arrangement corresponding to that of FIG. 1 during electric operation when the detent pawl drive is turned on;

DETAILED DESCRIPTION OF THE PREFERRED EMBODIMENT

Figure 1:
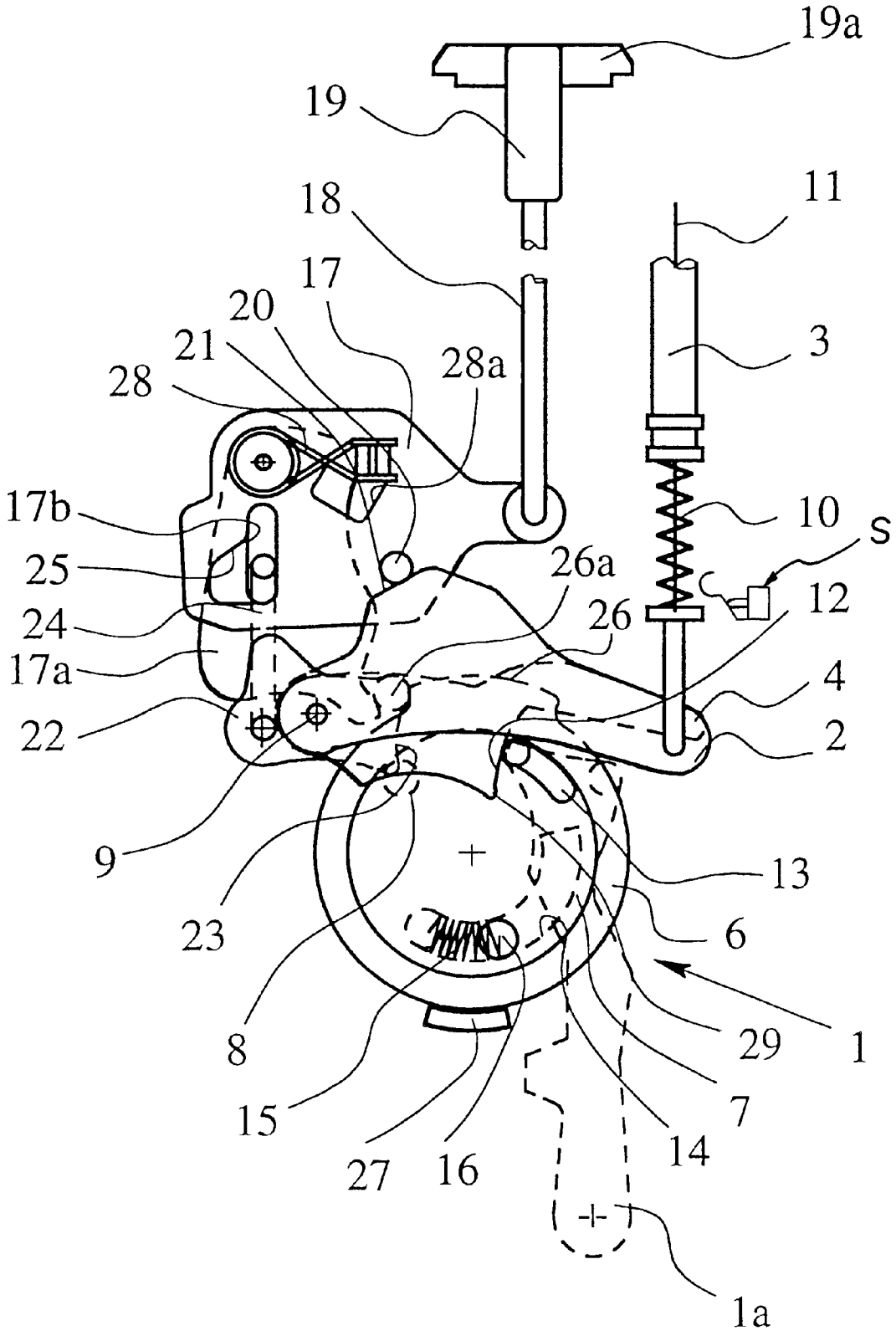
FIG. 1 shows the base position of a motor vehicle door lock arrangement in accordance with an embodiment of the invention in the normal position.

The drawings show, first of all, a detent pawl 1*a* from a motor vehicle door lock arrangement by a broken line, not a conventional lock latch. Detent pawl 1*a* holds the lock latch, as usual, in a main catch, and optionally, also a forward catch (see, for example, DE-A-195 45 722). Electric detent pawl drive 1 and a mechanical opening lever 2 that acts on the detent pawl are shown. In this embodiment, mechanical opening lever 2 is a lever which is joined to an inside opening lever via a Bowden cable 3. Accordingly, opening lever 2 can also and additionally be connected to an outside handle or lock cylinder. To do this, of course, other lever connections are necessary which for the sake of simplification of the drawings are not shown here, since they are not important for the understanding of the present invention.

The control switches for triggering electrical detent pawl drive 1 and the power supply connection for the entire electrical system of the door lock arrangement are not shown. However, such also are not necessary for an understanding of this invention and the nature and use thereof will be known to those ordinary skilled in the art.

A catch lever 4 is supported on the same bearing axle 9 as is opening lever 2. In interaction with opening lever 2, the catch lever 4 has the functions detailed below. It is important for the function that catch lever 4, jointly with opening lever 2, is pulled upwards by means of Bowden cable 3; but, when the inside opening lever is released, lever 4 need not necessarily return with opening lever 2 to the normal position shown in FIG. 1.

Figure 3:
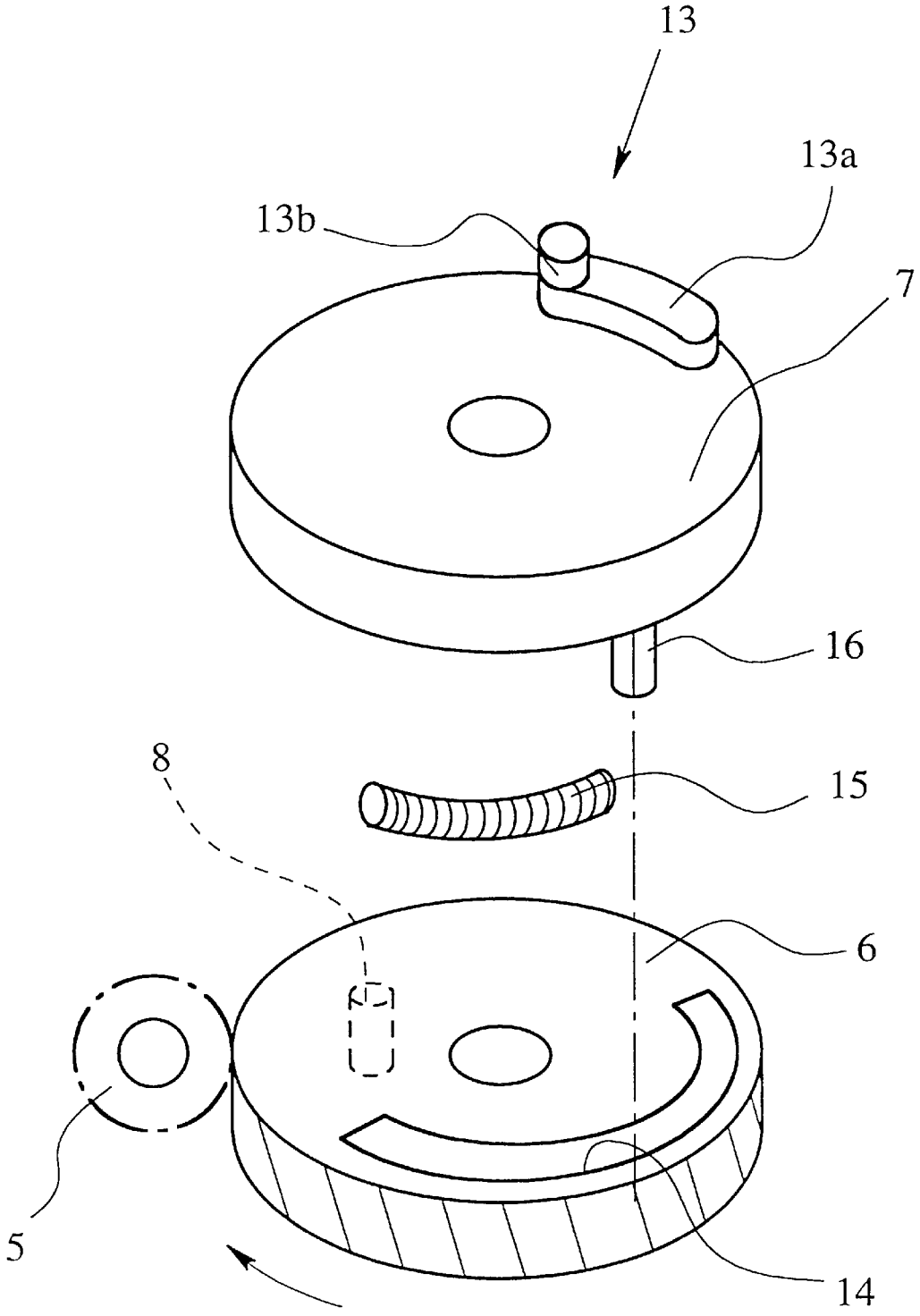
FIG. 3 shows a detent pawl drive of a motor vehicle door locking arrangement as shown in FIG. 1 in an exploded view.
Figure 4:
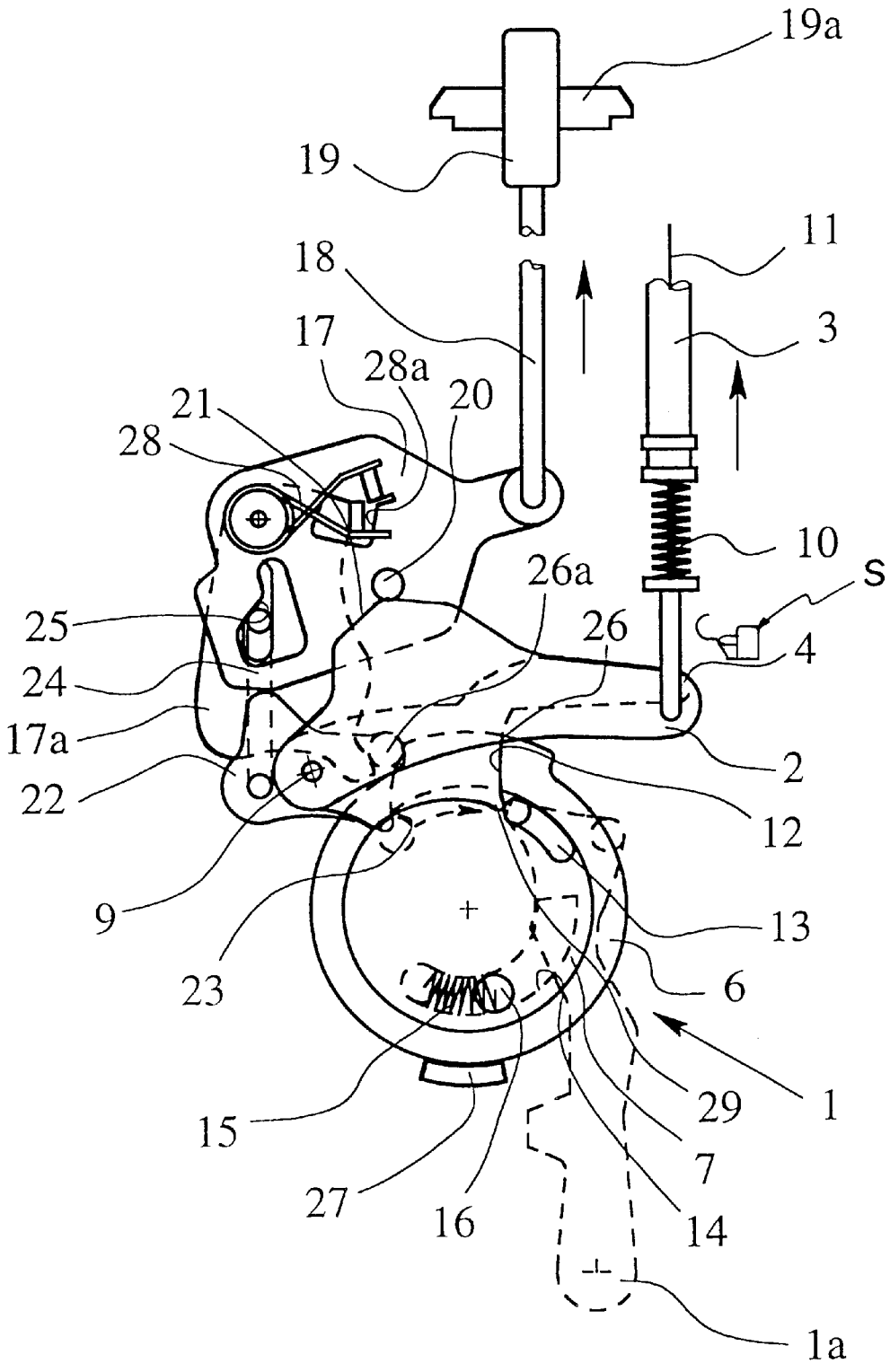

In particular, electrical detent pawl drive 1 is made as a worm wheel drive with an electric drive motor (not shown), a worm 5 (FIG. 3) and a worm wheel 6. In the embodiment shown, worm wheel 6 is coupled to a ratchet wheel 7 located coaxially to it; this is explained later. As FIG. 3 shows, a driving lug 8 is provided on worm wheel 6. Driving lug 8 serves for lifting detent pawl 1*a* from the forward catch or main catch of the lock latch; therefore, it acts to open the door lock arrangement. The direction of the arrow indicates that clockwise rotation of worm wheel 6 produces the opening function, which is triggered by one of the control switches (the "open by wire" function). In FIGS. 1, 4, 5, & 6, driving lug 8 is shown by a broken line since it is hidden on the back of detent pawl drive 1. FIGS. 1 and 4 show detent pawl 1*a* by the broken line, the broken-line arrow in FIG. 4 pointed clockwise representing the movement of driving lug 8 in the "open by wire" function.

A plurality of other types of detent pawl drives 1 are known from the prior art and can be used alternatively.

Furthermore, it is apparent that the opening lever 2 is supported to pivot on bearing axle 9 and is coupled to the core wire 11 of Bowden cable 3 that leads to the inside opening lever. Also shown is the fact that the core wire 11 is pre-tensioned by a reset spring 10 in the reset direction.

The embodiment shown illustrates a catch lever 4 which has a lifting edge 12 on which an indexing bolt 13 of ratchet wheel 7 stops and is held when worm wheel 6 is turned counterclockwise. So that worm wheel 6, regardless of the holding of ratchet wheel 7 by striking of indexing bolt 13 against lifting edge 12, can continue to run until the rest position of electric detent pawl drive 1 is reached, a compression spring is provided in an arc-shaped recess 14 in worm wheel 6 as one embodiment of a mechanical energy storage device 15. A holding pin 16 projects out of ratchet wheel 7 into recess 14. Between holding pin 16 and the end of recess 14 that is on the left in FIG. 3, the mechanical energy storage device 15, e.g., a compression spring, is inserted which therefore always presses ratchet wheel 7 in a counterclockwise direction relative to worm wheel 6.

FIG. 1 also shows a locking lever 17 which interacts with opening lever 2 and which, in the embodiment shown, is coupled to an inside lock button 19 via a rod 18. This is also only an example of a suitable version. FIG. 1 shows locking lever 17 in its lowermost position; here, inside lock button 19 has disappeared in the door, only a lock button receiver 19*a* of which is shown. A coupling pin 20 on locking lever 17 interacts with a control crank 21 on opening lever 2. If opening lever 2 is pulled into the position shown in FIG. 2, at the same time, locking lever 17 is, likewise, raised by means of control crank 21 and coupling pin 20, so that the inside lock button 19 becomes visible in the recess on the door.

In the embodiment shown, an auxiliary locking lever 17*a* that lies in a plane behind locking lever 17 in FIG. 1 is assigned to locking lever 17. It can be seen from FIG. 1 in conjunction with FIG. 4 that, in the normal state, only the locking lever 17 that is connected to the rod 18 and the inside lock button 19 can be moved against the spring force of a leg spring 28. FIG. 4 in comparison to FIG. 1 makes it clear that a recess 28*a* in locking lever 17 allows deflection of locking lever 17 against the spring force of leg spring 28 as auxiliary locking lever 17*a* remains stationary. Below it is explained how auxiliary locking lever 17*a* is blocked in this normal state so that the function in FIG. 4 can take place.

In this embodiment, likewise, coupling lever is mounted on bearing axle 9 of opening lever 2, and has a control edge 23 which lies, viewed in a counterclockwise direction, "behind" lifting edge 12 of catch lever 4. This coupling lever 22 is joined to auxiliary locking lever 17*a* by means of connecting rod 24. Connecting rod 24 runs in a in longitudinal slot 17*b* in auxiliary locking lever 17*a*, and its end lies in recess 25 of locking lever 17. This recess 25 allows certain movements of locking lever 17 due to its special shape relative to auxiliary locking lever 17*a*, as can be seen in the transition from FIG. 1 to FIG. 4.

In FIG. 1, the coupling lever 22 with connecting rod 24 is inoperative. Locking lever 17 can, as shown in FIG. 4, be moved freely, in any case, against the reset force of leg spring 28. Auxiliary locking lever 17*a* remains stationary. This is due to the fact that coupling lever 22 hinders auxiliary locking lever 17*a* from pivoting counterclockwise by means of indexing pin 26*a*.

Figure 5:
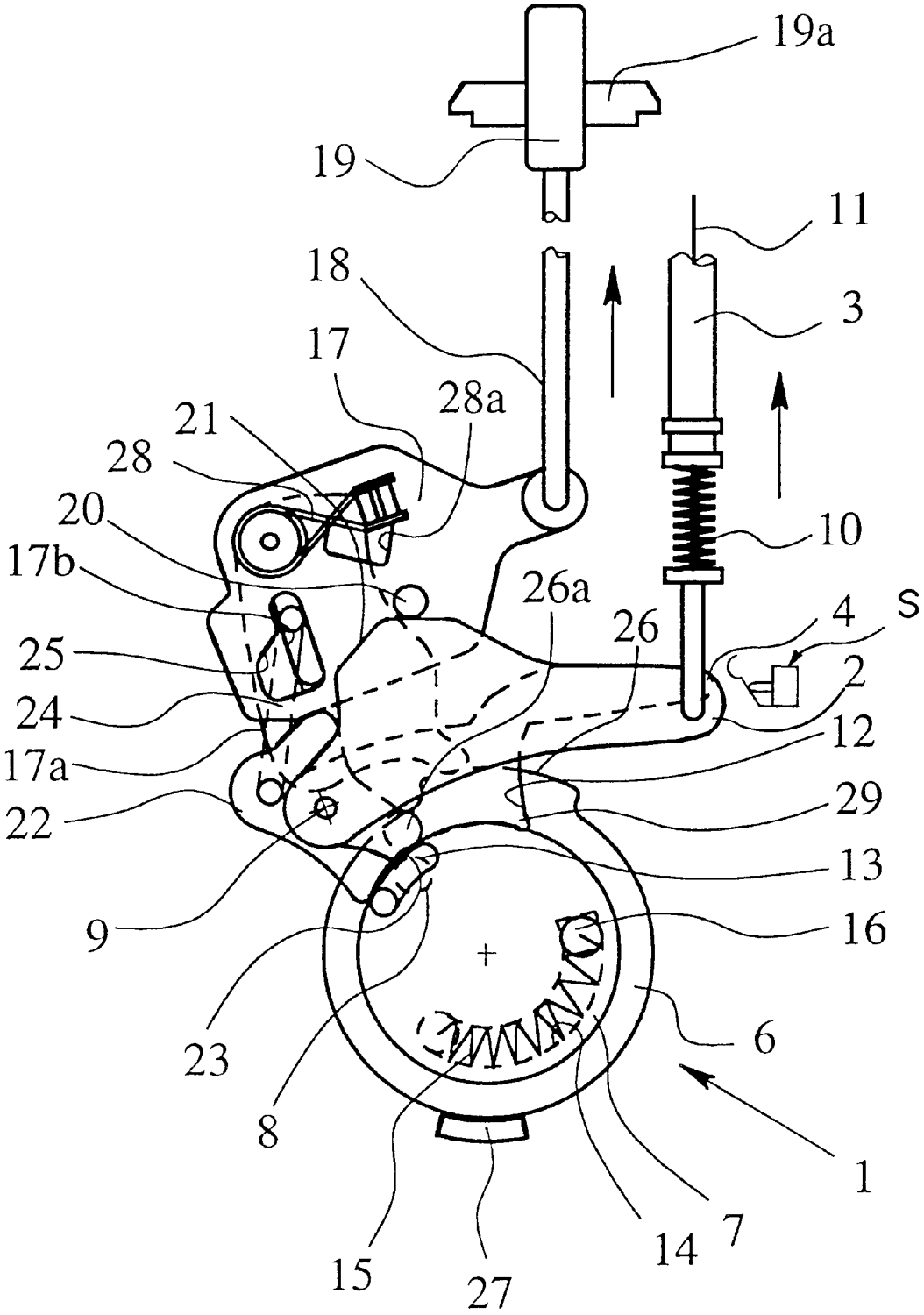
FIG. 5 is a view of the motor vehicle door lock arrangement corresponding to that of FIG. 1 during mechanical operation with the opening lever mechanically actuated.
Figure 6:
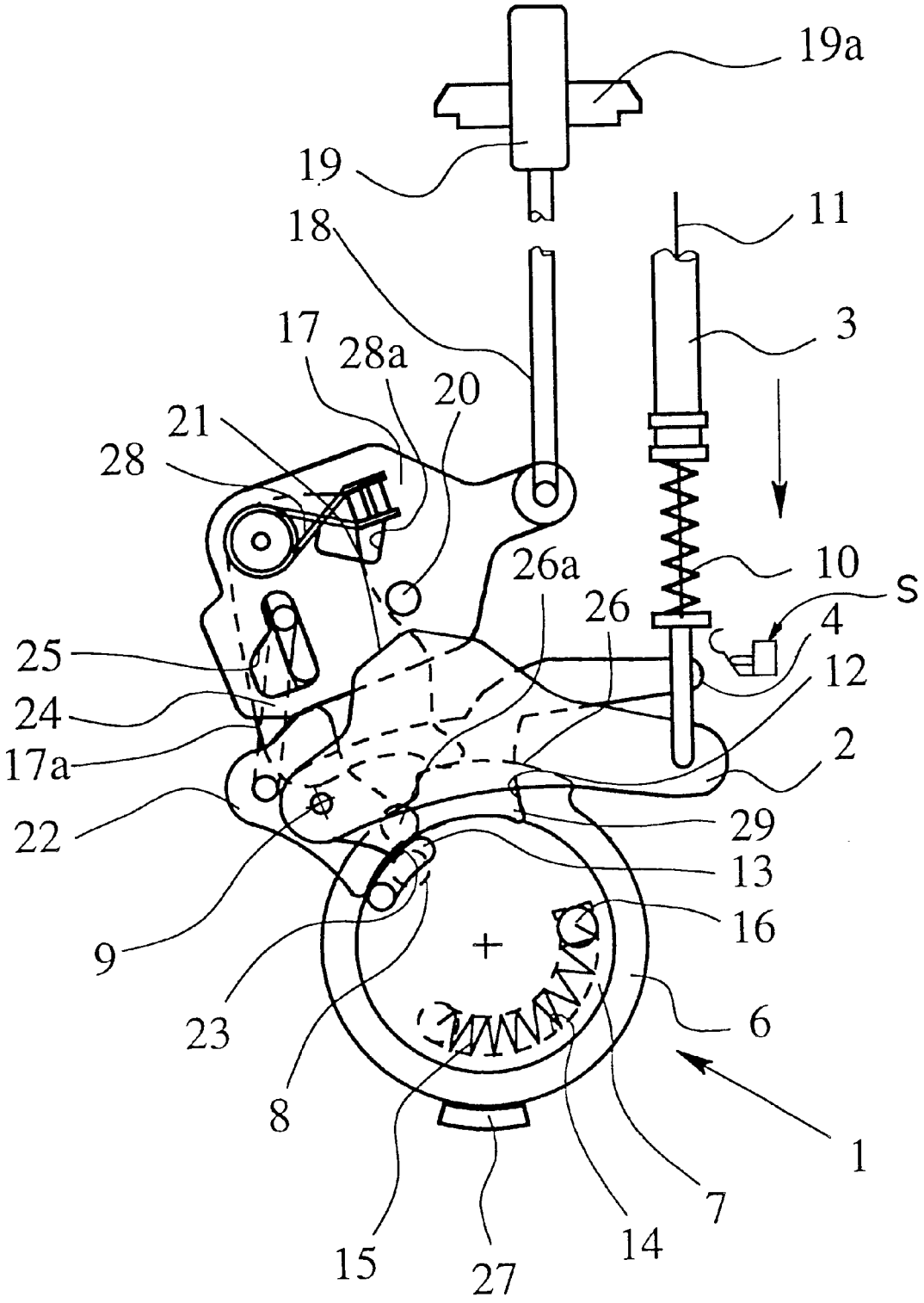
FIG. 6 is a view of the motor vehicle door locking arrangement from FIG. 1, during mechanical operation, in the base position.

In FIGS. 5 and 6, on the other hand, it can be seen that, here, connecting rod 24 has run to the top in longitudinal hole 17*b* and also lies on the upper edge of recess 25 in locking lever 17.

Figure 2:
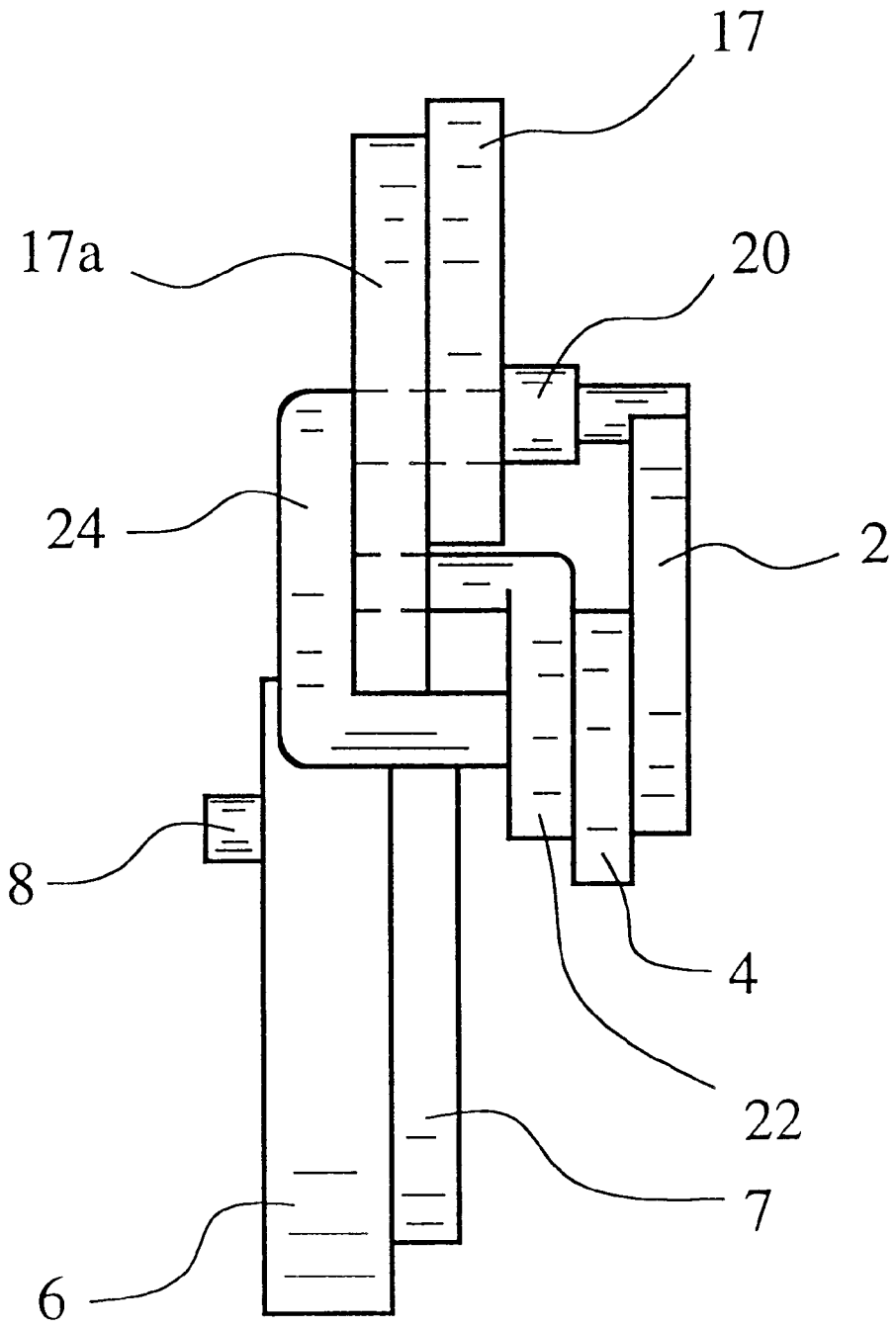
FIG. 2 shows a portion of the motor vehicle door lock arrangement from FIG. 1 in a schematic side view from the left in FIG. 1.

FIG. 2 shows the axial positioning of the different levers of the motor vehicle door lock arrangement relative to each other. It can be seen that connecting rod 24, relative to FIG. 1, extends behind the levers but then extends forwardly into the plane of coupling lever 22 at one end and into the plane of locking lever 17 at the other end. The frontmost plane is occupied by opening lever 2. Otherwise detent pawl 1*a* which in FIG. 2 is on the extreme left at the height of driving pin 8 shown there is not shown in FIG. 2. In addition, the other elements which establish the trigger connection to detent pawl 1*a* in the emergency position are not shown on the left in FIG. 2.

Finally, in FIGS. 1 and 4 through 6, on the lower edge of lifting edge 12 of catch lever 4, there is projection 29 which exercises a resistance to pulling on inside opening element (Bowden cable 3), before indexing bolt 13 comes away from lifting edge 12 of catch lever 4. On the first segment of the path of the inside opening lever, therefore, the "open by wire" function is triggered via the corresponding control switch S. If detent pawl drive 1 reacts to the switch function of the control switch, worm wheel 6 of detent pawl drive 1 runs immediately clockwise, as illustrated in FIG. 4, so that mechanical energy storage device 15 is immediately released and detent pawl 1*a* is raised. Then, in the embodiment shown, for mechanical operation, opening lever 2 is no longer activated entirely by itself. On the other hand, if it is ascertained that electric operation is not being initiated, by further movement of the inside opening lever in the same direction, after passage of projection 29 and overcoming the increased mechanical resistance given, accordingly, opening lever 2 can be mechanically activated and mechanical operation initiated.

FIG. 3 shows that indexing bolt 13 has a lower, bean-shaped part 13*a* and a top, pin-shaped part 13*b*. Bean-shaped part 13*a* is used for interaction with coupling lever 22 and catch lever 4, and pin-shaped part 13*b* extends into the plane of opening lever 2.

Finally, it can be seen that another control crank 26 is provided on the outside edge of worm wheel 6, and a stop 27 is located at the lower edge to control the detent pawl drive 1.

This embodiment of a motor vehicle door lock arrangement of the invention works as follows.

FIG. 1 shows the base position or rest position of electric detent pawl drive 1. In this position, the worm wheel 6 of the electric detent pawl drive 1 is in its initial position. Indexing bolt 13 of ratchet wheel 7 is on lifting edge 12 of catch lever 4 in this position. Since worm wheel 6 has continued to run relative to ratchet wheel 7 into the rest position, in this position, mechanical energy storage device 15, i.e., the compression spring, has been compressed. This is clearly shown in FIG. 1.

Now, if by actuating electrical control switch S. here, when the inside opening lever is actuated, the "open by wire" function is triggered, worm wheel 6 runs clockwise until control crank 26 reaches stop 27 (which can be seen underneath the outer edge) and reverses direction of rotation of the electric drive motor of detent pawl drive 1 (reversing or calibration point) by stopping on stop 27. FIGS. 3 and 4 show by the illustrated arrow (which is a broken line arrow in FIG. 4) that driving pin 8 will lift detent pawl 1*a* during this movement, directly or indirectly with the interposition of other components, so that the lock latch is released for opening of the lock. It is apparent that, at the same time, the left end of recess 14, likewise, moves clockwise so that the compression spring which forms mechanical energy storage device 15 can stretch, therefore mechanical energy storage device 15 is discharged.

It is shown in FIG. 4 that, in this actuation motion for the "open by wire" function, locking lever 17 is briefly raised with auxiliary locking lever 17*a* remaining stationary, so that inside lock button 19 briefly emerges from receiver 19*a* on the inside lining of the motor vehicle door. After releasing the inside opening lever, by which Bowden cable 3 is reset, opening lever 2 falls back out of the position in FIG. 4 into the position of FIG. 1, under the reset force of leg spring 28, the locking lever 17 is, likewise, again reset downward, inside lock button 19 disappears again into receiver 19*a*. Here, no mechanical activation has taken place. After reversal of the electric drive motor, worm wheel 6 turns back into the initial position, i.e., the rest position of detent pawl drive 1 which is shown in FIG. 1. In this position, mechanical energy storage device 15 is tensioned again, i.e., the compression spring compressed.

In this embodiment, it would not be possible to mechanically actuate the opening lever 2 by electrical operation when the inside opening lever is pulled harder and farther, i.e., the opening lever 2 being pulled upward farther and harder than in FIG. 4. Due to the prompt starting of the detent pawl drive 1, energy storage device 15 would be immediately discharged so that indexing bolt 13 on detent pawl drive 1 does not leave its position shown in FIG. 1 or even turn at the same time somewhat clockwise. This measure easily prevents possible switching to mechanical operation intentionally or unintentionally without failure of electrical operation.

FIG. 1 shows the position in which the motor vehicle door lock arrangement of the invention is located during most of the time of operation of a motor vehicle, it is the normal position or also the rest position of detent pawl drive 1. This embodiment therefore shows that energy storage device 15, in the rest position of detent pawl drive 1, keeps opening lever 2 always ready for mechanical activation. Energy storage device 15 is always tensioned. This tension of energy storage device 15, however, is mechanically absorbed via lifting edge 12 and indexing bolt 13 so that there is no continuing power consumption as would be the case in a solenoid.

If, at this point, in the position shown in FIG. 1, power supply fails, for example, because a plug comes loose or a cable breaks, the vehicle occupant ascertains that the "open by wire" function is no longer working. If actuation of the "open by wire" function has taken place by a special key, or for example, by actuating a remote control from the outside, the user decision follows to now execute the emergency function. From the outside, this means using a key. From the inside, this can mean that the vehicle occupant instinctively reaches for the inside opening lever because he is accustomed to the classical, purely mechanical motor vehicle door lock arrangement.

This embodiment of the motor vehicle door lock arrangement uses the aforementioned behavior pattern, modified this such that, as is conventional, pulling on the inside opening lever on the first part of the path triggers the "open by wire" function. If the power supply is working properly and this function is then executed, a vehicle occupant simply releases the inside opening lever, and under the spring force of reset spring 10, it snaps back. If, on the other hand, the occupant ascertains that the function is not being executed, he continues to pull harder on the inside opening lever. It is shown in FIG. 5 what happens in this case. By actuating the inside opening lever, core 11 of Bowden cable 3 is pulled against the force of reset spring 10, opening lever 2 with catch lever 4 is swivelled counterclockwise around bearing axle 9, lifting edge 12 is pushed via projection 29 out of the path of motion of indexing bolt 13 on ratchet wheel 7. Since, as explained above, mechanical energy storage device 15 is tensioned between the ratchet wheel 7 and worm wheel 6, ratchet wheel 7 is turned counterclockwise. Indexing bolt 13 strikes control edge 23 of coupling lever 22 and swivels it clockwise around the bearing axle 9. At the same time, the indexing bolt 26*a* is shifted down by displacement of coupling lever 22, out of the path of the projection on auxiliary locking lever 17*a*. In this way, the auxiliary locking lever 17*a* can now move together with locking lever 17 upward. As a result the position of FIG. 5 is reached, in which coupling rod 24 has run upward in longitudinal slot 17*b* of auxiliary locking lever 17*a* and is also located on the top edge of recess 25 in locking lever 17.

FIG. 6 shows what happens when, after switching into mechanical operation as shown in FIG. 5, the inside opening lever is released. Under the spring force of reset spring 10, core 11 of Bowden cable 3 is reset, opening lever 2 returns to the position shown in FIG. 1. Catch lever 4, on the other hand, pauses in the raised position. By means of coupling rod 24, proceeding from the coupling lever 22 held in the raised position, locking lever 17 and auxiliary locking lever 17*a* also pause, inside locking button 19 is permanently in the raised position shown in FIG. 6. Opening lever 22 is now mechanically activated, the connection to detent pawl 1*a* is established. If inside opening lever is pulled again, opening lever 2 is raised, a dynamic connection to detent pawl 1*a* is established, and the detent pawl is mechanically actuated.

During this mechanical operation, the motor vehicle must be mechanically locked and unlocked via the lock cylinder from the outside. Projection of inside lock button 19 from receiver 19*a* on the inside lining of the door signals mechanical operation.

In this state, motion takes place directly from the lock cylinder from auxiliary locking lever 17*a*, locking lever 17 being entrained and bringing inside lock button 19 into the position which is the proper one at the time. In this situation, coupling lever 22 remains in its mechanical position shown in FIG. 6, coupling rod 24 pivots only around the bearing point in coupling lever 22. However, the levers 17 and 17*a* are coupled by form-fit and move together.

If an electrical malfunction has occurred again, with actuation of the "open by wire" function, a complete reset of electrical detent pawl drive 1 can take place. In this triggering, worm wheel 6, with ratchet wheel 7, returns clockwise into the position in which the control crank 26 is on the stop 27, so that coupling lever 22 is released again by indexing bolt 13. Coupling lever 22 can then return under spring force into its initial position shown in FIG. 1. The door lock arrangement is reset again.

It is possible that a vehicle occupant using inside lock button 19 recognizes the function of the door lock arrangement, i.e., recognizes that the electrical system has failed. By engagement of the mechanism, in this embodiment, it is insured that the occupant must work with the mechanical door lock and use mechanical activation until the power supply is restored. This forces the user to go to the repair shop.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Motor vehicle door lock arrangement comprising a detent pawl, and an electrical detent pawl drive for actuating the detent pawl, a control switch for triggering the electrical detent pawl drive, and a lock mechanism with at least one mechanical opening lever which acts on the detent pawl, the detent pawl being actuatable in a normal case only by the electrical detent pawl drive, and in an emergency, being actuatable by a mechanical opening lever;

wherein the electrical detent pawl drive is provided with a mechanical energy storage device which is tensioned in a rest position of the detent pawl drive and keeps the opening lever prepared for mechanical activation when a malfunction occurs; and wherein the mechanical energy storage device is connected to the opening lever by a means for causing, upon discharge of energy stored in the mechanical energy storage device, the opening lever to move one of a locking lever and a coupling lever from a locking position in which the detent pawl is isolated into an unlocking position in which the detent pawl is coupled to the opening lever.

2. Motor vehicle door lock arrangement as claimed in claim 1, wherein the detent pawl drive has two parts which are coupled to one another, but which are movable to a limited degree relative to one another; and wherein the mechanical energy storage device acts between the two parts of the detent pawl drive.

3. Motor vehicle door lock arrangement comprising a detent pawl, a detent pawl drive for actuating the detent pawl, a control switch for triggering the detent pawl drive, and a lock mechanism with at least one mechanical opening lever which acts on the detent pawl, the detent pawl being actuatable in a normal case only by the electrical detent pawl drive, and in an emergency, being actuatable by a mechanical opening lever; wherein the electrical detent pawl drive is provided with a mechanical energy storage device which is tensioned in a rest position of the detent pawl drive and keeps the opening lever prepared for mechanical activation when a malfunction occurs; and wherein the detent pawl drive has two parts which are coupled to one another, but which are movable to a limited degree relative to one another; and wherein the mechanical energy storage device acts between the two parts of the detent pawl drive.

4. Motor vehicle door lock arrangement as claimed in claim 3, wherein the detent pawl drive comprises a worm wheel drive having a worm wheel and ratchet wheel arranged coaxial to the worm wheel, and between which mechanical energy storage device is located.

5. Motor vehicle door lock arrangement as claimed in claim 1, wherein the opening lever is mechanical activatable by actuation of the opening lever itself.

6. Motor vehicle door lock arrangement as claimed in claim 1, wherein a control switch for triggering of the electrical detent pawl drive is actuatable with the opening lever; and wherein the opening lever is mechanical activatable by actuation of the opening lever beyond an actuation point for the control switch.

7. Motor vehicle door lock arrangement as claimed in claim 6, further comprising means for producing a clearly discernible mechanical resistance when the opening lever is actuated beyond the actuation point for the control switch and before mechanical activation of the opening lever occurs.

8. Motor vehicle door lock arrangement as claimed in claim 6, further comprising means for returning the opening lever to the rest position after mechanical activation of opening lever before re-actuation of the opening lever also actuates the detent pawl.

9. Motor vehicle door lock arrangement as claimed in claims 6, further comprising means for immediately releasing the mechanical energy storage device after turning on electrical detent pawl drive, so that further actuation of opening lever leads to mechanical activation of opening lever.

10. Motor vehicle door lock arrangement comprising a detent pawl, an electrical detent pawl drive for actuating the detent pawl, a control switch for triggering the detent pawl drive and a lock mechanism with at least one mechanical opening lever which acts on the detent pawl, the detent pawl being actuatable in a normal case only by the electrical detent pawl drive, and in an emergency, being actuatable by a mechanical opening lever; wherein the electrical detent pawl drive is provided with a mechanical energy storage device which is tensioned in a rest position of the detent pawl drive and keeps the opening lever prepared for mechanical activation when a malfunction occurs; and further comprising means for returning the opening lever to the rest position after mechanical activation of the opening lever before re-actuation of the opening lever also actuates the detent pawl.

11. Motor vehicle door lock arrangement comprising a detent pawl, and an electrical detent pawl drive for actuating the detent pawl, a control switch for triggering the detent pawl drive, and a lock mechanism with at least one mechanical opening lever which acts on the detent pawl, the detent pawl being actuatable in a normal case only by the electrical detent pawl drive, and in an emergency, being actuatable by a mechanical opening lever; wherein the electrical detent pawl drive is provided with a mechanical energy storage device which is tensioned in a rest position of the detent pawl drive and keeps the opening lever prepared for mechanical activation when a malfunction occurs; and further comprising means for immediately releasing the mechanical energy storage device after turning on the electrical detent pawl drive, so that further actuation of the opening lever leads to mechanical activation of the opening lever.

12. Motor vehicle door lock arrangement as claimed in claim 3, wherein the opening lever is mechanical activatable by actuation of opening lever itself.

13. Motor vehicle door lock arrangement comprising a detent pawl, and an electrical detent pawl drive for actuating the detent pawl, a control switch for triggering the detent pawl drive, and a lock mechanism with at least one mechanical opening lever which acts on the detent pawl, the detent pawl being actuatable in a normal case only by the electrical detent pawl drive, and in an emergency, being actuatable by a mechanical opening lever; wherein the electrical detent pawl drive is provided with a mechanical energy storage device which is tensioned in a rest position of the detent pawl drive and keeps the opening lever prepared for mechanical activation when a malfunction occurs; and wherein the opening lever is mechanical activatable by actuation of the opening lever itself.

* * * * *